United States Patent [19]

Nissman

[11] Patent Number: 4,461,082

[45] Date of Patent: Jul. 24, 1984

[54] ENGRAVING MACHINE

[75] Inventor: Marvin J. Nissman, Great Neck, N.Y.

[73] Assignee: New Hermes Incorporated, New York, N.Y.

[21] Appl. No.: 395,937

[22] Filed: Jul. 7, 1982

[51] Int. Cl.[3] ..... B41F 1/07; B43L 13/10

[52] U.S. Cl. ..... 33/25 B; 33/25 D

[58] Field of Search ..... 33/23 R, 23 B, 23 D, 33/24 R, 25 R, 25 B, 25 C, 25 D

[56] References Cited

U.S. PATENT DOCUMENTS 2,729,892 1/1956 Gruettner ..... 33/25 R
3,110,966 11/1963 Hillig ..... 33/25 B
3,584,535 6/1971 Rossberger ..... 33/25 B
4,369,701 1/1983 Richardson et al. ..... 33/25 D

OTHER PUBLICATIONS

The Engravers Journal, May/Jun. 1981, pp. 8, 32–38.
Richardson's Operating Manual and parts list, 5 pages.

*Primary Examiner*—Richard R. Stearns
*Attorney, Agent, or Firm*—Seidel, Gonda & Goldhammer

[57] ABSTRACT

The frame of an engraving machine supports a slide for movement in a first horizontal direction. A pantograph is pivoted to the slide for movement about a vertical axis. A tool holder is supported by the pantograph. The tool holder is prevented from pivoting so that inscribed lines will have different widths.

10 Claims, 4 Drawing Figures

10
12
14
16
18
20
22
24
26
27
28
30
32
33
34
36
38
40
42
44
46
48
50
52
54
56
57
58
59
60
61
62
63
64
66
68
70
72
80
82
84
86
88

FIG. 2
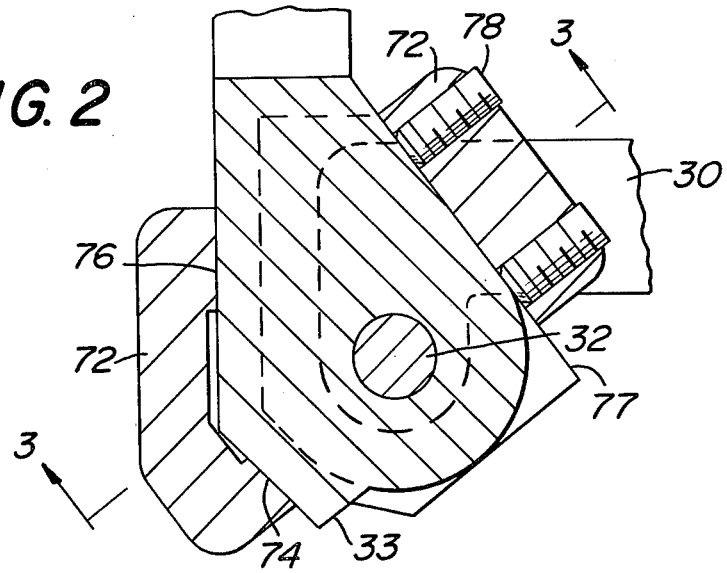
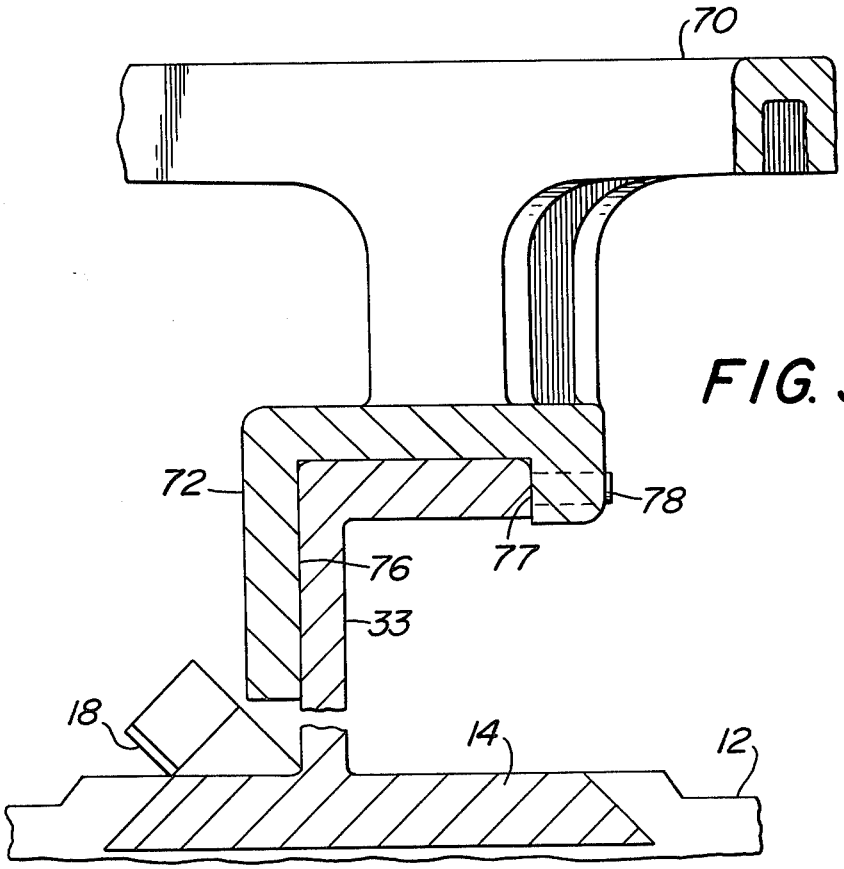
FIG. 3

ENGRAVING MACHINE

BACKGROUND

It is known in the art of engraving to use an engraving tool having a blunt edge so that the inscribed line will be wide when the tool is moved in one direction and narrow when moved in another direction. Such a tool must be prevented from pivoting about its longitudinal axis. The engraving machine is also capable of being used with different shaped cutting tools which are desirably pivotable about their longitudinal axis. Conversion of the machine for use with each type of tool is necessary. Heretofore, such conversion was quite complicated and time consuming.

The present invention is directed to solution of the problem of simplifying conversion of the engraving machine from use with one type of tool to use with another type of tool, and wherein one of said tools requires that it be held fast so that it cannot pivot about its longitudinal axis when in use.

SUMMARY OF THE INVENTION

The engraving machine of the present invention includes a frame on which is mounted a slide. Adjustment means is provided for adjusting the slide in a first horizontal direction. A pantograph is pivoted to the slide for pivotable movement about a vertical axis. A tool holder is supported by the pantograph. A means is removably mounted on the slide are removably connected to the tool holder for preventing the tool holder from pivoting about its longitudinal axis, whereby each of said pantograph and said means are mounted on a common support.

It is an object of the present invention to provide a common support for a pantograph and means for preventing a tool holder from pivoting about its longitudinal axis in a manner which facilitates easy and rapid conversion when it is desired to use a tool holder which pivots about its longitudinal axis.

It is another object of the present invention to provide positive means for locating a guide rod on a slide and perpendicular to the direction of horizontal movement of the slide.

Other objects and advantages will appear hereinafter.

For the purpose of illustrating the invention, there is shown in the drawing a form which is presently preferred; it being understood, however, that this invention is not limited to the precise arrangements and instrumentalities shown.

FIG. 2 is a sectional view taken along the line 2—2 in FIG. 1 but on an enlarged scale.

FIG. 3 is a sectional view taken along the line 3—3 in FIG. 2.

DETAILED DESCRIPTION

Figures 1, 4:
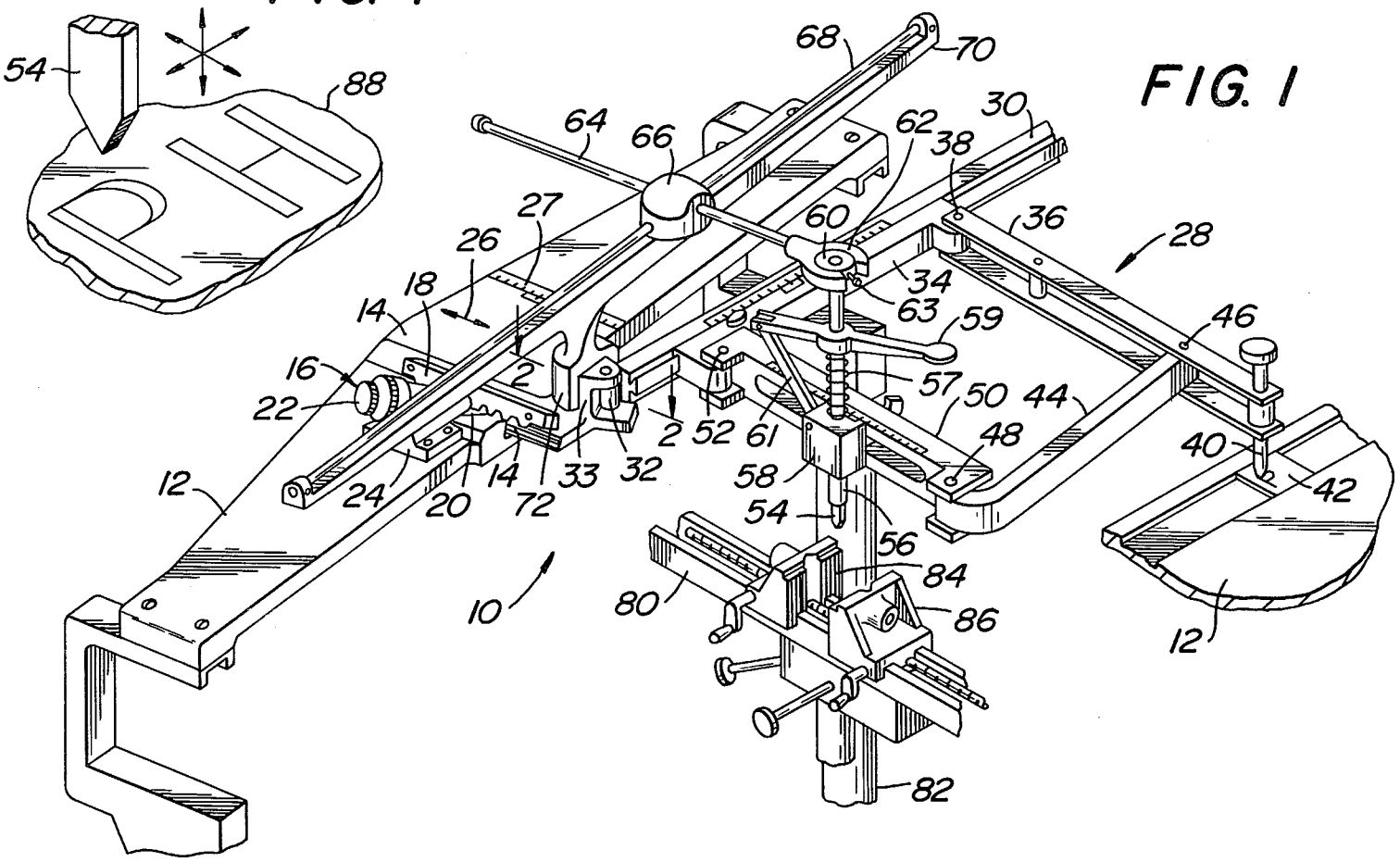
FIG. 1 is a partial perspective view of an engraving machine in accordance with the present invention.
FIG. 4 is a partial perspective view of a workpiece being engraved.

Referring to the drawing in detail, wherein like numerals indicate like elements, there is shown in FIG. 1 a partial perspective view of an engraving machine in accordance with the present invention designated generally as 10. The machine 10 includes a frame 12 supported by legs not shown. A dovetail slide 14 is supported by the frame 12. A means 16 is provided for selectively adjusting the slide 14 relative to the frame

12. The adjustment means 16 includes a rack 18 on the slide 14. A pinion 20 is connected to graduated knobs on bracket 24. Pinion 20 meshes with the rack 18. Bracket 24 is fixedly secured to the frame 12. Rotation of the graduated knob 22 facilitates adjustment of the slide 14 in a horizontal direction as indicated by arrow 26.

A pantograph 28 is pivotably connected to bracket 33 on the slide 14 by way of pivot pin 32. A wide variety of pantographs are known. The preferred embodiment for the pantograph 28 is illustrated in FIG. 1 and includes arm 30 pivoted at one end to the pivot pin 32 for movement through an arc of about 135°. An auxiliary arm 34 has a dovetail groove slidably supported on arm 30. Each of arm 30 and 34 have graduations thereon. Set screws for facilitating retention after adjustment of auxiliary arm 34 are not shown.

The pantograph 28 includes arm 36 pivotably connected at one end by way of pin 38 to one end of the auxiliary arm 34. At its other end, the arm 36 supports a scribe 40. Scribe 40 is adapted to trace indicia on a plate 42 removably supported on a frame 12. Arm 36 is pivotably connected to one end of arm 34 by pivot pin 46. The other end of arm 44 is pivotably connected to one end of arm 50 by a pivot 48. The other end of arm 50 is pivotably connected to the other end of arm 34 by pivot pin 52.

A cutting tool 54 is removably attached to the lower end of a vertically disposed tool holder 56 by a set screw not shown. The cutting tool 54 is blunt on one side as shown more clearly in FIG. 4 so that it will engrave a wide line when moved in one direction and a narrow line when moved in a perpendicular direction. The upper end of the tool holder 56 is secured to a collar 60 by way of a set screw 63. The tool holder 56 is guided for vertical movement by a bracket 58 adjustably attached to the arm 50 of the pantograph 28. Downward adjustment of the tool holder 56 is attained by way of a lever 59 through which the tool holder 56 extends. A spring 57 surrounds tool holder 56 and biases the righthand end of lever 59 upwardly. The lefthand end of lever 59 is pivoted to a link 61 which is pivoted to the bracket 58. A collar not shown on the tool holder 56 contacts the bottom surface of the lever 59.

The collar 60 is removably attached to a jaw 62 at one end of rod 64. Rod 64 is slidably supported for movement in a horizontal direction by a follower 66. Follower 66 is pivotably mounted on a rod 68. Rods 64 and 68 are mutually perpendicular. Rod 68 is supported at its ends by a yoke 70 having a mounting 72 intermediate its ends.

The mounting 72 is removably attached to the bracket 33 on the slide 14 as shown more clearly in FIGS. 2 and 3. Bracket 33 has surfaces 74 and 76 which intersect to form an obtuse angle of approximately 135°. The bracket 33 on its opposite side from surface 44 has a surface 77. Surfaces 76 and 77 converge toward one another with the included angle being approximately 37°.

The mounting 72 is readily attached to the bracket 33 by a pair of set screws 78 engaging the surface 77. In order to convert from use with tool 54 to a different tool which may pivot about its longitudinal axis, it is merely necessary to remove the set screws 78 and remove the set screw 63 to disconnect collar 60 and jaws 62. The yoke 70 along with all elements supported thereby including rod 64 are removed and placed into storage.

Thereafter, a different type of tool may be attached to the tool holder 56.

The angular arrangement of surfaces 74, 76 and 77 assures that the rod 68 will be perpendicular to rod 64 and will also be perpendicular to the direction of arrow 26. The pantograph is pivotable through an angle of 135° with one extremity of arm 30 being shown in FIG. 2. Since the yoke 70 is supported by the slide 14, the tool holder 56 is always in proper registration. Bracket 58 is preferably adjustable along the length of arm 50. Any such adjustment of the bracket 58 is accomodated by the rod 64 sliding relative to its follower 66.

In use, a workpiece 88 is supported by the jaws 84 and 86 on the track 80. Track 80 is supported by a vertical pedestal 82 on frame 12. Scribe 40 is traced along the indicia on plate 42 while the righthand end of lever 59 is pressed downwardly to cause the tool 54 to engrave said indicia on the workpiece 88.

As shown in FIG. 4, the tool 54 will engrave indicia having wide and narrow portions. For example, the horizontal middle leg of the "H" will be narrow while the vertical legs will be wide. As shown in FIG. 4, there is a gradual transition from a narrow line to a wide line as engraving a letter such as the letter "P".

The movement of the scribe 40 in a horizontal direction is accomodated by pivoting of the pantograph 28 with follower 66 sliding along rod 68. Other portions of the indicia to be scribed may cause the pantograph 28 to pivot in another direction with the tool holder 56 moving away from the pivot pin 32. This is accomodated by rod 64 sliding relative to follower 68. Any adjustment of the slide 14 automatically adjusts the yoke 70 and the pantograph 28. When the tool holder 56 is moved downwardly by applying finger pressure on the righthand end of lever 59, the follower 66 pivots about the rod 68. Thus, it will be seen that the engraving machine of the present invention solves the problem described above in a manner which is simple, reliable, and inexpensive.

The present invention may be embodied in other specific forms without departing from the spirit or essential attributes thereof and, accordingly, reference should be made to the appended claims, rather than to the foregoing specification, as indicating the scope of the invention.

I claim:

1. In an engraving machine comprising a frame, a slide on said frame, means on said frame for adjusting said slide in a first horizontal direction, a pantograph, said pantograph being pivoted to said slide for pivotable movement about a vertical axis, an elongated tool holder supported by said pantograph, and means removably mounted on said slide and removably connected to said tool holder for preventing said tool holder from pivoting about its longitudinal axis, said means including a guide rod horizontally disposed and generally perpendicular to said first direction, said means including a support for said guide rod, said support being releasably mounted only on said slide, means for preventing said support from pivoting relative to said slide, and means movably supported by said guide rod and connected to said tool holder for guiding movement of the tool holder in a horizontal direction parallel to said guide rod.

2. In an engraving machine in accordance with claim 1, wherein said support has converging surfaces with an included angle of approximately 135° engaging mating surfaces on a bracket fixed to said slide.

3. In an engraving machine in accordance with claim 1 wherein said support is connected to a bracket on said slide only by a pair of fasteners which engage the same surface on said bracket.

4. In an engraving machine comprising a frame, a slide on said frame, means for adjusting said slide in a horizontal direction relative to said frame, a pivot for a pantograph on said slide, a mounting bracket on said slide, a yoke having a guide rod horizontally disposed and perpendicular to said first mentioned direction, said yoke having only one upstanding support member releasably connected only to said bracket in a manner whereby said yoke cannot pivot relative to the slide.

5. In an engraving machine in accordance with claim 4 wherein the ends of guide rod are supported by the ends of the yoke.

6. In an engraving machine in accordance with claim 4 wherein said support member has converging surfaces with an included obtuse angle on one side and engaging mating surfaces on said bracket, and a pair of fasteners on the opposite side of said support member and engaging said bracket for releasably interconnecting said yoke to said bracket.

7. In an engraving machine in accordance with claim 6 wherein said angle is approximately 135°.

8. In an engraving machine in accordance with claim 6 wherein said obtuse angle corresponds generally to the angle of pivotable movement of said pantograph pivot.

9. In an engraving machine comprising a frame, a slide on said frame, means on said frame for adjusting said slide in a horizontal direction, a pantograph, said pantograph being pivoted to said slide for pivotable movement about a vertical axis of approximately 135°, an elongated tool holder supported by said pantograph, a bracket on said slide, means supported by said bracket for preventing said tool holder from pivoting about its longitudinal axis, said means having converging surfaces which are vertically disposed, said surfaces cooperating with said bracket to define the pivotable range of said pantograph.

10. An attachment for use in an engraving machine comprising a yoke having a pair of generally horizontal arms supporting the ends of a horizontally disposed rod, a mounting on the lower end of said yoke adapted for mating contact with a bracket of an engraving machine, said mounting including vertically disposed inner converging surfaces whose included angle is about 135°, said mounting having fastener means for facilitating coupling the yoke to a bracket on an engraving machine, and a follower slidably supported by said rod.

* * * * *